US009463856B2

(12) United States Patent
Matsumoto et al.

(10) Patent No.: US 9,463,856 B2
(45) Date of Patent: Oct. 11, 2016

(54) SHIP OF CONTRAROTATING PROPELLER PROPULSION TYPE

(71) Applicant: MITSUBISHI HEAVY INDUSTRIES, LTD., Tokyo (JP)

(72) Inventors: Daisuke Matsumoto, Tokyo (JP); Shingen Takeda, Tokyo (JP); Takashi Unseki, Tokyo (JP); Ryota Kuroiwa, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/421,996

(22) PCT Filed: Aug. 22, 2013

(86) PCT No.: PCT/JP2013/072409

§ 371 (c)(1),
(2) Date: Feb. 16, 2015

(87) PCT Pub. No.: WO2014/030697

PCT Pub. Date: Feb. 27, 2014

(65) Prior Publication Data

US 2015/0239540 A1 Aug. 27, 2015

(30) Foreign Application Priority Data

Aug. 22, 2012 (JP) ..... 2012-183130

(51) Int. Cl.
*B63H 5/125* (2006.01)
*B63H 20/08* (2006.01)
(Continued)

(52) U.S. Cl.
CPC *B63H 5/10* (2013.01); *B63H 1/14* (2013.01); *B63H 5/125* (2013.01); *B63H 25/02* (2013.01); *B63H 25/38* (2013.01); *B63H 25/42* (2013.01)

(58) Field of Classification Search
CPC ..... B63H 1/14; B63H 5/10; B63H 5/125; B63H 25/00; B63H 25/02; B63H 25/38; B63H 25/42; B63H 2001/14; B63H 2005/10; B63H 2005/125; B63H 2025/00; B63H 2025/02; B63H 2025/38
USPC ..... 440/49, 53, 61 S, 79, 80, 82
See application file for complete search history.

(56) References Cited

U.S. PATENT DOCUMENTS

2003/0140836 A1 7/2003 Sakamoto et al.
2004/0198108 A1 10/2004 Levander
(Continued)

FOREIGN PATENT DOCUMENTS

CN 87214029 U 10/1988
CN 1496318 A 5/2004
(Continued)

OTHER PUBLICATIONS

Extended European Search Report mailed Jun. 5, 2015, corresponding to European patent application No. 13830463.9.
(Continued)

*Primary Examiner* — Daniel V Venne
(74) *Attorney, Agent, or Firm* — Kanesaka Berner and Partners LLP

(57) ABSTRACT

A ship includes a main propeller; a pod propulsion unit; and a rudder plate. The main propeller, the pod propulsion unit and the rudder plate are arranged on a hull centerline in this order. The pod propulsion unit includes a pod propeller; and a strut. The main propeller and the pod propeller configure a contrarotating propeller. When rudder angles of the pod propulsion unit and the rudder plate are zero, at least a part of a front end of the rudder plate is in front of a rear end of the casing.

7 Claims, 3 Drawing Sheets

(51) Int. Cl.

| | |
|---|---|
| ***B63H 5/10*** | (2006.01) |
| ***B63H 25/38*** | (2006.01) |
| ***B63H 25/42*** | (2006.01) |
| ***B63H 1/14*** | (2006.01) |
| ***B63H 25/02*** | (2006.01) |

(56) References Cited

U.S. PATENT DOCUMENTS

| | | | | |
|---|---|---|---|---|
| 2006/0172632 | A1 | 8/2006 | Veikonheimo et al. | |
| 2006/0246793 | A1 | 11/2006 | Korhonen et al. | |
| 2013/0316602 | A1 * | 11/2013 | Kokkila ..... | B63H 5/10 440/6 |

FOREIGN PATENT DOCUMENTS

| | | | | |
|---|---|---|---|---|
| CN | 1535894 | A | 10/2004 | |
| FI | 1466826 | A2 * | 10/2004 | ..... B63H 5/10 |
| JP | 60-52198 | U | 4/1985 | |
| JP | 60-114097 | U | 8/1985 | |
| JP | 2003-212189 | A | 7/2003 | |
| JP | 2004-182096 | A | 7/2004 | |
| JP | 2004-306947 | A | 11/2004 | |
| JP | 2005-47305 | A | 2/2005 | |
| JP | 2005-255127 | A | 9/2005 | |
| JP | 2006-510532 | A | 3/2006 | |
| JP | 2006-103490 | A | 4/2006 | |
| JP | 2010-254293 | A | 11/2010 | |
| WO | 2012/085341 | A1 | 6/2012 | |
| WO | 2012/104303 | A1 | 8/2012 | |

OTHER PUBLICATIONS

International Search Report mailed Nov. 19, 2013, corresponding to International application No. PCT/JP2013/072409.

International preliminary report on patentability mailed Mar. 5, 2015, corresponding to PCT/JP2013/072409.

Office Action in JP Application No. 2012-183130, mailed Mar. 15, 2016.

Office Action in CN Application No. 201380042518.5, mailed Apr. 1, 2016, with translation of Search Report part.

Office Action in KR Application No. 10-2015-7003793, dated Jun. 17, 2016.

* cited by examiner

SHIP OF CONTRAROTATING PROPELLER PROPULSION TYPE

RELATED APPLICATIONS

The present application is a National Phase of International Application Number PCT/JP2013/072409, filed Aug. 22, 2013, and claims priority of Japanese Patent Application No. 2012-183130 filed on Aug. 22, 2012.

TECHNICAL FIELD

The present invention relates to a ship in which a main propeller and a propeller of a pod propulsion unit configure a contrarotating propeller.

BACKGROUND ART

A ship provided with a pod propulsion unit is known. The pod propulsion unit is provided with a pod and a propeller which is driven by a propeller driving mechanism disposed in the pod. A propulsion function is achieved by the propeller. A steering function is achieved by changing the orientation of the pod propulsion unit by a steering mechanism disposed in the hull.

Patent Literature 1 discloses a ship provided with a pod propulsion unit. The pod propulsion unit is installed to a hull shell plate in the rear portion of the hull through a strut to be rotatable around a perpendicular axis. This ship is provided with a steering unit which is independent from the pod propulsion unit. The rudder plate of the independent steering unit is arranged behind the strut and is installed to the hull to be rotatable around a perpendicular axis. The rudder plate can be rotated without an interference that strut and the rudder collide.

The pod propulsion unit is not operated or is operated by a small rudder angle at the time of a steering operation test in a test sailing, a high-speed sailing, or a large rudder angle sailing for urgent avoidance, and the rudder plate of the independent steering unit is operated to a necessary rudder angle, e.g. a maximum rudder angle to generate enough rudder force. Because the rudder plate is arranged behind the strut in neighborhood to the strut, the large rudder force can be obtained by using the interference with a flow of water. Because the pod propulsion unit is not operated or is operated by the small rudder angle, there is no case that the large force acts on the pod propulsion unit, and furthermore damage due to erosion can be prevented. Note that Patent Literature 1 does not disclose that a contrarotating propeller is configured from the propeller of the pod propulsion unit and another propeller.

Patent Literature 2 discloses a ship that a main propeller and a propeller of a pod type propulsion unit configure a contrarotating propeller. The pod type propulsion unit has a support axis installed to the hull to be rotatable, a body section installed to the lower end of the support axis, a fin installed under the body section, and a propeller rotatably driven by a motor built in the body section. The support axis is rotatably driven by a motor disposed in the hull. In the pod type promotion apparatus, both of the support axis and the fin function as rudders. In this ship, two rudders are disposed for both sides of the pod type propulsion unit. The two rudders are arranged in middle positions between the centerline of the hull and the sides of the ship. Because the ship has the pod type propulsion unit with the support axis to achieve the function of the rudder, the ship does not originally have to provide the two rudders. However, in a high-speed sailing, cavitation occurs in the neighborhood of the support axis. Because this cavitation is remarkable as the rudder angle is large, the rudder angle of the support axis is limited to an angle within a predetermined angle range in the high-speed sailing. Thus, because it brought about hinderance to the sailing of the ship, the two rudders are provided.

Patent Literature 2 discloses another ship in which the main propeller and the propeller of the pod type propulsion unit configure the contrarotating propeller. In the other ship, one rudder is installed behind the pod type propulsion unit. Because it is sufficient to provide a single rudder, an installation cost is reduced, compared with a case to install two rudders. In addition, because the rudder is provided in a position where the rudder interacts with a water flow generated by the main propeller and the propeller of the pod type propulsion unit, an enough steering ability can be secured even if the rudder is singular.

Patent Literature 3 discloses a ship in which a main propeller, a pod propulsion unit, and a rudder are provided in order from the bow side to be aligned on a keel line.

CITATION LIST

[Patent literature 1] JP 2006-103490A
[Patent literature 2] JP 2004-182096A
[Patent literature 3] JP 2003-212189A

SUMMARY OF THE INVENTION

An object of the present invention is to restrain the increase of resistance due to a rudder (auxiliary rudder) provided except for a pod propulsion unit while maintaining CRP (contrarotating propeller) effect in a high-speed sailing, in a ship that a main propeller and a propeller of the pod propulsion unit configure a contrarotating propeller.

A ship according to an aspect of the present invention includes a main propeller; a pod propulsion unit steered by a first steering mechanism; and a rudder plate steered by a second steering mechanism. The main propeller, the pod propulsion unit and the rudder plate are arranged on a hull centerline. The pod propulsion unit includes: a casing; a propeller driving mechanism disposed in the casing; a pod propeller driven by the propeller driving mechanism; and a strut installed to the casing. The pod propulsion unit is arranged behind the main propeller, and the rudder plate is arranged behind the strut. The main propeller and the pod propeller configure a contrarotating propeller. When rudder angles of the pod propulsion unit and the rudder plate are zero, at least a part of a front end of the rudder plate is in front of a rear end of the casing.

A front end of the rudder plate includes a front end underside part and a front end topside part extending vertically from the front end underside part. A rear end of the strut includes a rear end underside part and a rear end topside part extending vertically from the rear end underside part. When the rudder angles of the pod propulsion unit and the rudder plate are zero, the front end underside part is arranged behind the rear end underside part, and the front end topside part is arranged behind the rear end topside part. The front end underside part and the rear end underside part are substantially parallel to each other, and the front end topside part and the rear end topside part are substantially parallel to each other.

According to another aspect of the present invention, a method of steering a ship, which includes a main propeller, a pod propulsion unit steered by a first steering mechanism, and a rudder plate steered by a second steering mechanism.

The main propeller, the pod propulsion unit and the rudder plate are arranged on a hull centerline. The pod propulsion unit includes: a casing; a propeller driving mechanism provided in the casing; a pod propeller driven by the propeller driving mechanism; and a strut installed to the casing. The pod propulsion unit is arranged behind the main propeller, and the rudder plate is arranged behind the strut. When rudder angles of the pod propulsion unit and the rudder plate are zero, at least a part of a front end of the rudder plate is in front of a rear end of the casing. In the method of steering the ship, the swirl flow generated by the main propeller is recovered by the pod propeller, and the rudder angle of the rudder plate is made large.

According to the present invention, in the ship in which the main propeller and the propeller of the pod propulsion unit configure a contrarotating propeller, the increase of resistance due to a rudder (auxiliary rudder) provided except for a pod propulsion unit is restrained while maintaining the CP (contrarotating propeller) effect in a high-speed sailing.

DESCRIPTION OF EMBODIMENTS

A ship and a method of steering the ship according to embodiments of the present invention will be described below with reference to the attached drawings.

[First Embodiment]

Figure 1:
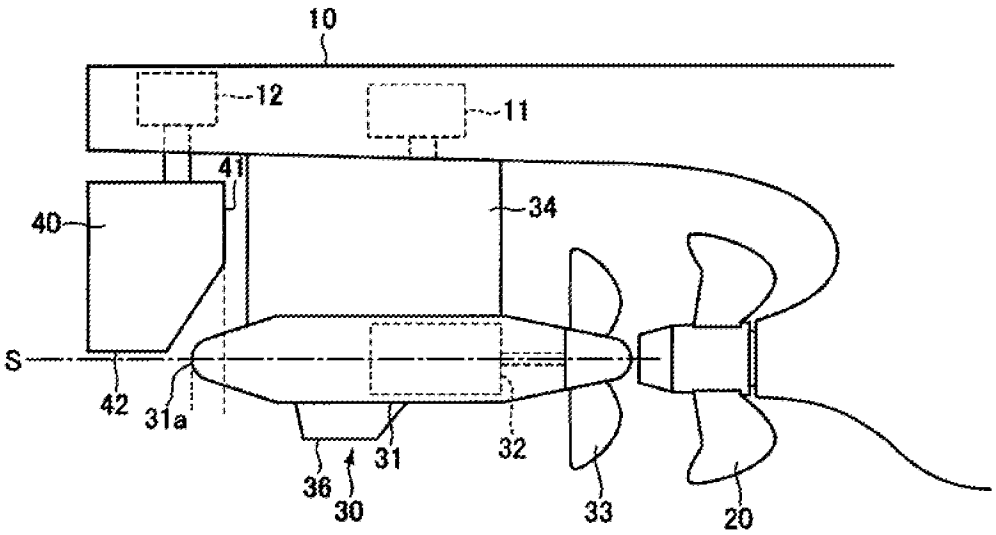
FIG. 1 is a side view of a stern section of a ship according to a first embodiment of the present invention.

Referring to FIG. 1, the ship according to a first embodiment of the present invention is provided with a hull 10, a steering mechanism 11 (corresponding to a first steering mechanism including a steering gear) disposed in the hull 10, a steering mechanism 12 (corresponding to a second steering mechanism including a steering gear) disposed in the hull 10, a main propeller 20, a pod propulsion unit 30 and a rudder plate 40. The steering mechanisms 11 and 12 are sometimes referred to as steering gears. The pod propulsion unit 30 is provided with a pod-shaped casing 31, a propeller driving mechanism 32 disposed in the casing 31, a pod propeller 33 driven by the propeller driving mechanism 32, a strut 34 installed to the casing 31 and a fin 36 installed to the casing 31. The fin 36 is arranged under the casing 31. For example, the propeller driving mechanism 32 is provided with a motor. The strut 34 is arranged on the casing 31 and has a function as a rudder. The main propeller 20 is driven by a main engine (not shown) disposed in the hull 10. The pod propulsion unit 30 is operated by the steering mechanism 11. The rudder plate 40 is operated by the steering mechanism 12. The rudder angle of the rudder plate 40 can be set independently from the pod propulsion unit 30. The pod propulsion unit 30 is arranged behind the main propeller 22. The rudder plate 40 is arranged behind the strut 34. The bottom end 42 of the rudder plate 40 may be arranged in a position which is upper than a rotation axis S of the pod propeller 33 or may be arranged in a position which is lower than the rotation axis S. It desirable that the section shapes of the strut 34 and rudder plate 40 are a wing form.

Figure 2:
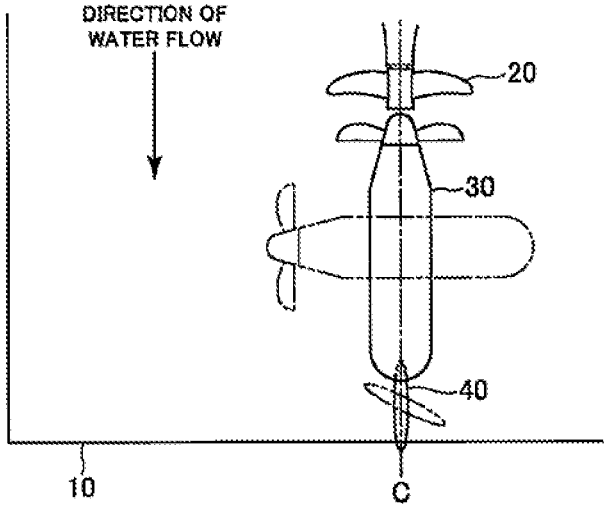
FIG. 2 is a bottom view of the stern section of the ship according to the first embodiment.

Referring to FIG. 2, the main propeller 20, the pod propulsion unit 30 and the rudder plate 40 are arranged on a hull centerline C.

The rudder angles of the pod propulsion unit 30 and rudder plate 40 are both zero in the condition shown in FIG. 1, and the pod propeller 33 is arranged in front of the casing 31. That is, the pod propeller 33 is arranged behind the main propeller 20 in the neighborhood of the main propeller 20. The main propeller 20 and the pod propeller 33 configure a contrarotating propeller. Because the strut 34 of the pod propulsion unit 30 and the rudder plate 40 are desirably as close to each other as possible, at least a part of the front end 41 of the rudder plate 40 is in front of the rear end 31*a* of the casing 31.

Next, the method of steering the rudder according to the first embodiment will be described.

When the ship according to the first embodiment sails at high speed, the rudder angles of the pod propulsion unit 30 and rudder plate 40 are zero or angles near zero. The main propeller 20 and the pod propeller 33 rotate in directions opposite to each other and configure a contrarotating propeller. That is, the CRP (contrarotating propeller) effect can be achieved in which the swirl flow generated by the main propeller 20 is recovered through the rotation of the pod propeller 33. The energy saving effect is achieved by the CRP effect. At the time of steering, the rudder angle of the rudder plate 40 is made large while the rudder angle of the pod propulsion unit 30 is maintained to an angle at which the CRP effect is achieved. Thus, the CRP effect is maintained at the high-speed sailing. Note that there is a possibility that the CRP effect is lost, if the steering is carried out by using the pod propulsion unit 30 at the high-speed sailing.

According to the first embodiment, the rudder plate 40 as one-sheet rudder is disposed behind the strut 34 as an auxiliary rudder. Therefore, compared with a case that two rudders are provided for both sides of the pod propulsion unit 30, the increase of resistance due to the auxiliary rudder can be restrained. For example, in case of some condition, the resistance increase when the two rudders are provided for both sides of the pod propulsion unit 30 is about 3%, but the resistance increase when the rudder plate 40 is provided is about 1%. Moreover, because at least a part of the front end 41 of the rudder plate 40 is in front of the rear end 31*a* of the casing 31, the rudder plate 40 and the strut 34 of the pod propulsion unit 30 are close to each other. Therefore, the resistance increase due to the rudder plate 40 becomes very small.

According to the first embodiment, the rudder plate 40 is arranged in the water flow accelerated by the main propeller 20 and the pod propeller 33. Therefore, the rudder force increases in an identical rudder angle and in an identical rudder area, compared with a case that the two rudders are provided for both sides of the pod propulsion unit 30. For example, in case of some condition, the increase of rudder force equal to or more than about 20% can be achieved.

According to the first embodiment, because the number of rudders and a rudder area necessary for the generation of identical rudder force can be reduced, compared with a case that the two rudders are provided for both sides of the pod propulsion unit 30, the cost of the whole rudder system including the rudder plate and the steering mechanism can be reduced.

[Second Embodiment]

The ship and the method of steering the ship according to a second embodiment of the present invention are same as those of the first embodiment except for the following description.

Figure 3:
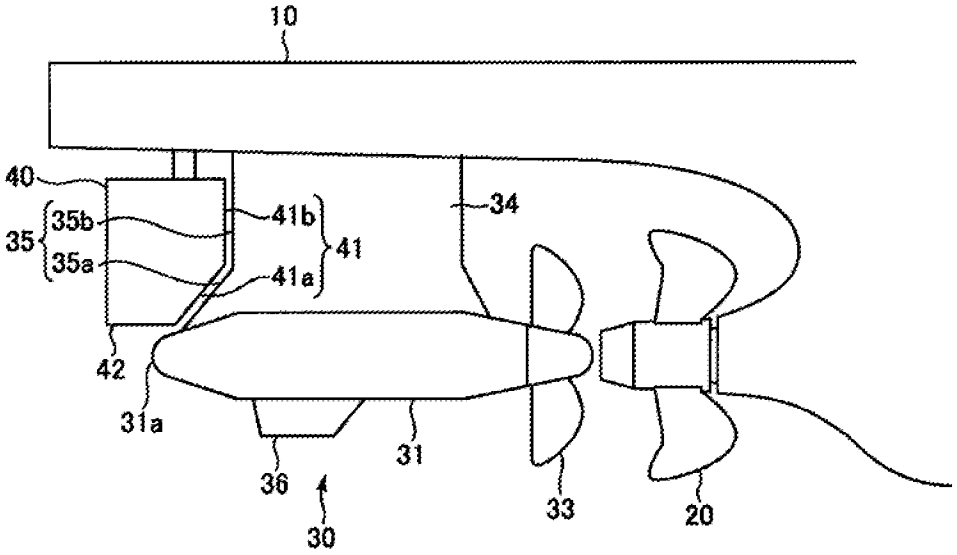
FIG. 3 is a side view of the stern section of the ship according to a second embodiment of the present invention.

Referring to FIG. 3, the front end 41 of the rudder plate 40 is provided with a front end underside part 41*a* and a front end topside part 41*b*. The front end topside part 41*b* is arranged on the front end underside part 41*a* and extends vertically from the front end underside part 41*a*. The rear end 35 of the strut 34 is provided with a rear end underside part 35*a*. and a rear end topside part 35*b*. The rear end topside part 35*b* is arranged on the rear end underside part 35*a* and extends vertically from the rear end underside part 35*a*.

When the rudder angles of the pod propulsion unit 30 and rudder plate 40 are zero, the front end underside part 41*a* is arranged behind the rear end underside part 35*a*. The front end topside part 41*b* is arranged behind the rear end topside part 35*b*. The front end underside part 41*a* and the rear end underside part 35*a* are arranged to be substantially parallel to each other, and the front end topside part 41*b* and the rear end topside part 35*b* are arranged to be substantially parallel to each other. Therefore, a space between the rudder plate 40 and the strut 34 can be made narrow and the resistance increase due to the rudder plate 40 is further restrained.

As described above, the ship and a method of steering the ship according to the present invention have been described with reference to the embodiments. However, the present invention is not limited to the above embodiments. The embodiments may be modified and combined.

Note that the present application claims a priority based on the Japanese patent application 2012-183130 filed on Aug. 22, 2012. The disclosure thereof is incorporated herein by reference.

The invention claimed is:

1. A ship comprising:

a main propeller;

a pod propulsion unit steered by a first steering mechanism; and a rudder plate steered by a second steering mechanism, wherein said main propeller, said pod propulsion unit and said rudder plate are arranged on a hull centerline, wherein said pod propulsion unit comprises:

a casing;

a propeller driving mechanism disposed in said casing;

a pod propeller driven by said propeller driving mechanism; and a strut installed on said casing, wherein said pod propulsion unit is arranged behind said main propeller, wherein said rudder plate is arranged behind said strut, wherein said main propeller and said pod propeller configure a contrarotating propeller, and wherein, when rudder angles of said pod propulsion unit and said rudder plate are zero, at least a part of a front end of said rudder plate is in front of a rear end of said casing.

2. The ship according to claim 1, wherein said front end of said rudder plate comprises a front end underside part and a front end topside part extending vertically from said front end underside part, wherein a rear end of said strut comprises a rear end underside part and a rear end topside part extending vertically from the rear end underside part, and wherein, when the rudder angles of said pod propulsion unit and said rudder plate are zero, said front end underside part is arranged behind said rear end underside part, said front end topside part is arranged behind said rear end topside part, said front end underside part and said rear end underside part are substantially parallel to each other, and said front end topside part and said rear end topside part are substantially parallel to each other.

3. A method of steering a ship which comprises a main propeller, a pod propulsion unit steered by a first steering mechanism, and a rudder plate steered by a second steering mechanism, wherein said main propeller, said pod propulsion unit and said rudder plate are arranged on a hull centerline, wherein said pod propulsion unit comprises:

a casing;

a propeller driving mechanism provided in said casing;

a pod propeller driven by said propeller driving mechanism; and a strut installed on said casing, wherein said pod propulsion unit is arranged behind said main propeller, wherein said rudder plate is arranged behind said strut, wherein, when rudder angles of said pod propulsion unit and said rudder plate are zero, at least a part of a front end of said rudder plate is in front of a rear end of said casing, the method comprising rotating said main propeller and said pod propeller in directions opposite to each other to configure a contrarotating propeller (CRP) and to recover a swirl flow generated by the main propeller through the rotation of the pod propeller, and wherein at the time of steering, making the rudder angle of the rudder plate larger while maintaining the rudder angle of the pod propulsion unit to an angle at which the effect of the contrarotating propeller is achieved.

4. The ship according to claim 1, wherein said strut is arranged on the casing and has a function as a rudder.

5. The ship according to claim 1, wherein a section shape of said strut is a wing form.

6. A ship comprising:

a main propeller;

a pod propulsion unit arranged to be steered by a first steering mechanism; and a rudder plate arranged to be steered by a second steering mechanism, wherein said main propeller, said pod propulsion unit and said rudder plate are arranged on a hull centerline, wherein said pod propulsion unit comprises:

a casing;

a propeller driving mechanism disposed in said casing;

a pod propeller arranged to be driven by said propeller driving mechanism; and a strut installed on said casing, wherein said pod propulsion unit is arranged behind said main propeller, wherein said rudder plate is arranged behind said strut, wherein said main propeller and said pod propeller configure a contrarotating propeller, wherein, when rudder angles of said pod propulsion unit and said rudder plate are zero, at least a part of a front end of said rudder plate is in front of a rear end of said casing, and wherein a bottom end of said rudder plate is arranged in a position which is above a rotation axis of said pod propeller.

7. The ship according to claim 6, wherein said front end of said rudder plate comprises a front end underside part and a front end topside part extending vertically from said front end underside part, wherein a rear end of said strut comprises a rear end underside part and a rear end topside part extending vertically from the rear end underside part, and wherein, when the rudder angles of said pod propulsion unit and said rudder plate are zero, said front end underside part is arranged behind said rear end underside part, said front end topside part is arranged behind said rear end topside part, said front end underside part and said rear end underside part are substantially parallel to each other, and said front end topside part and said rear end topside part are substantially parallel to each other.

* * * * *